US006736711B2

(12) United States Patent
Tiede

(10) Patent No.: US 6,736,711 B2
(45) Date of Patent: May 18, 2004

(54) HAND-CONTROLLED GRINDING TOOL, FOR MACHINING ROUND OBJECTS

(75) Inventor: Steffen Tiede, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 101 days.

(21) Appl. No.: 10/049,347

(22) PCT Filed: Apr. 12, 2001

(86) PCT No.: PCT/DE01/01433

§ 371 (c)(1),
(2), (4) Date: Jan. 30, 2002

(87) PCT Pub. No.: WO02/07930

PCT Pub. Date: Jan. 31, 2002

(65) Prior Publication Data

US 2002/0137447 A1 Sep. 26, 2002

(30) Foreign Application Priority Data

Jul. 20, 2000 (DE) ..... 100 35 219

(51) Int. Cl.[7] ..... B24B 27/08

(52) U.S. Cl. ..... 451/355; 451/49; 451/490; 451/513; 451/524

(58) Field of Search ..... 451/49, 50, 355, 451/356, 525, 490, 524, 513, 523, 296

(56) References Cited

U.S. PATENT DOCUMENTS

| | | | | | |
|---|---|---|---|---|---|
| 3,091,061 | A | * | 5/1963 | Bahr | 451/355 |
| 3,461,511 | A | * | 8/1969 | Perina | 24/31 V |
| 4,551,951 | A | * | 11/1985 | Nace | 451/355 |
| 4,869,026 | A | | 9/1989 | Burrell | |
| 5,381,801 | A | * | 1/1995 | McShane et al. | 128/848 |
| 5,484,328 | A | * | 1/1996 | Osterman | 451/356 |
| 5,840,141 | A | * | 11/1998 | Korbel | 156/153 |
| 5,993,304 | A | | 11/1999 | Eriksson | |

FOREIGN PATENT DOCUMENTS

| | | |
|---|---|---|
| DE | 34 47 828 | 7/1986 |

* cited by examiner

*Primary Examiner*—Timothy V. Eley
(74) *Attorney, Agent, or Firm*—Michael J. Striker

(57) ABSTRACT

In a power grinder (1) with a motor (6) and a gear (7) that drive an oscillating drive means (2), which moves a grinding belt (3) secured to it to reciprocate, a simple change of the grinding belt (3) is made possible by providing that the grinding belt (3) has a hook-and-loop closure (4), or the grinding belt (3) is disposed with its first end (11) on the drive means (2), and its second end (12) is connected to a handle (13).

11 Claims, 4 Drawing Sheets

HAND-CONTROLLED GRINDING TOOL, FOR MACHINING ROUND OBJECTS

BACKGROUND OF THE INVENTION

The invention is based on a power grinder, having a motor and a gear that drive an oscillating drive means about a deflection angle; the drive means drives a grinding belt, secured to it, to reciprocate.

For machining round objects in the built-in state, it is necessary for the grinding belt to adapt to the radius of that object. Moreover, there must be a possibility of releasing or closing the grinding belt. This is attained, by the devices available on the market, by means of an endless grinding belt. If built-in objects are to be ground, the grinding belt must be severed and then glued together again afterward. This is very complicated and expensive.

From German Patent Disclosure DE 34 47 828 A1, a motor-drivable grinding apparatus is also known, which is used for grinding, smoothing and polishing of preferably round bars and tubes. It uses an open grinding belt, wrapped in a loop around the workpiece, that is held by its two ends in two clamping or tensioning devices of the grinding apparatus. Via a movement device, a gear that can be driven by motor in a rotary motion in the same direction sets the two clamping and tensioning devices and thus also the grinding belt into an alternating, synchronized opposed motion, which pulls the grinding belt over the workpiece. Thus the grinding action is attained. Although such an oscillating motion enables high operating safety and good manipulation of the grinding apparatus, nevertheless the effort and expense for changing the grinding means is very high, since the grinding belt has to be removed with its ends from the clamping or tensioning device, and the new grinding belt has to be inserted back into this device.

SUMMARY OF THE INVENTION

A power grinder according to the invention has the advantage over the prior art that a simple change of the grinding belt is possible. By means of the closure on the grinding belt, it is unnecessary to perform complicated cutting apart and gluing of the grinding belt, or releasing and securing the ends from and to a clamping or tensioning device. The release and securing of the grinding belt is done for instance in the case of a hook-and-loop closure by simple pressing actions, without requiring additional steps. Moreover, the hook-and-loop closure offers adequately high security against an unintended release.

It is advantageous if the closure is in engagement with the drive means. To that end, in the case of a hook-and-loop closure, for instance, the grinding belt is first wrapped around the object to be machined and is then pressed with its two ends against the drive means; the counterparts of the hook-and-loop closure of the grinding belt are disposed on the drive means. Another option is to guide the grinding belt, once it has been wrapped around the object to be machined, all the way around the entire drive means and to join the two ends of the grinding belt directly to one another, between the drive means and the object to be machined, by means of a hook-and-loop closure.

It is especially advantageous if the drive means is a swing head, which in particular takes the form of a wheel. As a result, it is possible in a simple way to wrap the grinding belt around the swing head and secure it to the swing head, or to connect its two ends together, between the swing head and the workpiece to be machined, as described above.

It is also advantageous if the face end of the gear, on its side remote from the motor, has a beveled drive shaft on which a peg that is in engagement with the drive means is disposed eccentrically. As a result, the driving motion, as a rule rotation, that is imparted by the gear is converted into an oscillating motion. This is done in a way that is very simple to achieve and is not very complicated structurally. It is especially preferred if the peg is seated in a sliding block guide on the drive means.

It is also preferred if the closure is embodied on the first end and on the second end of the grinding belt. Compared to being disposed inside the grinding belt, the entire length of the grinding belt can thus be utilized. This contributes to making it possible for round objects with quite different diameters to be machined with the same grinding belt.

Another feature according to the invention provides that the grinding belt is disposed with its first end on the drive means and its second end is connected to a handle. Once again, this makes simple changing of the grinding belt possible. It is also thereby especially simply possible to wrap the grinding belt around the object to machined, since the grinding belt does not have to be released from its fastening points at all.

It is advantageous if an elastic element, is disposed between the second end of the grinding belt and the handle. As a result, the oscillating motion of the grinding belt is not transmitted in full to the handle and hence to the hand of the user.

It is also advantageous if the first end of the grinding belt is mounted rotatably on the drive means. As a result, in places that are hard to reach but need to be machined, this makes it possible for the user not to have to assume unnatural hand and arm positions.

It is also advantageous if the drive means is a machine insert. As a result, the grinder is universally usable, since still other inserts besides the grinding belt can be coupled to the machine insert.

Further advantageous features of the invention are the subject of the dependent claims.

BRIEF DESCRIPTION OF THE DRAWINGS

Exemplary embodiments of the invention are described in further detail in the ensuing description in conjunction with the associated drawing.

Shown are.

DETAILED DESCRIPTION OF THE PREFERRED EMBODIMENTS

Figure 1:
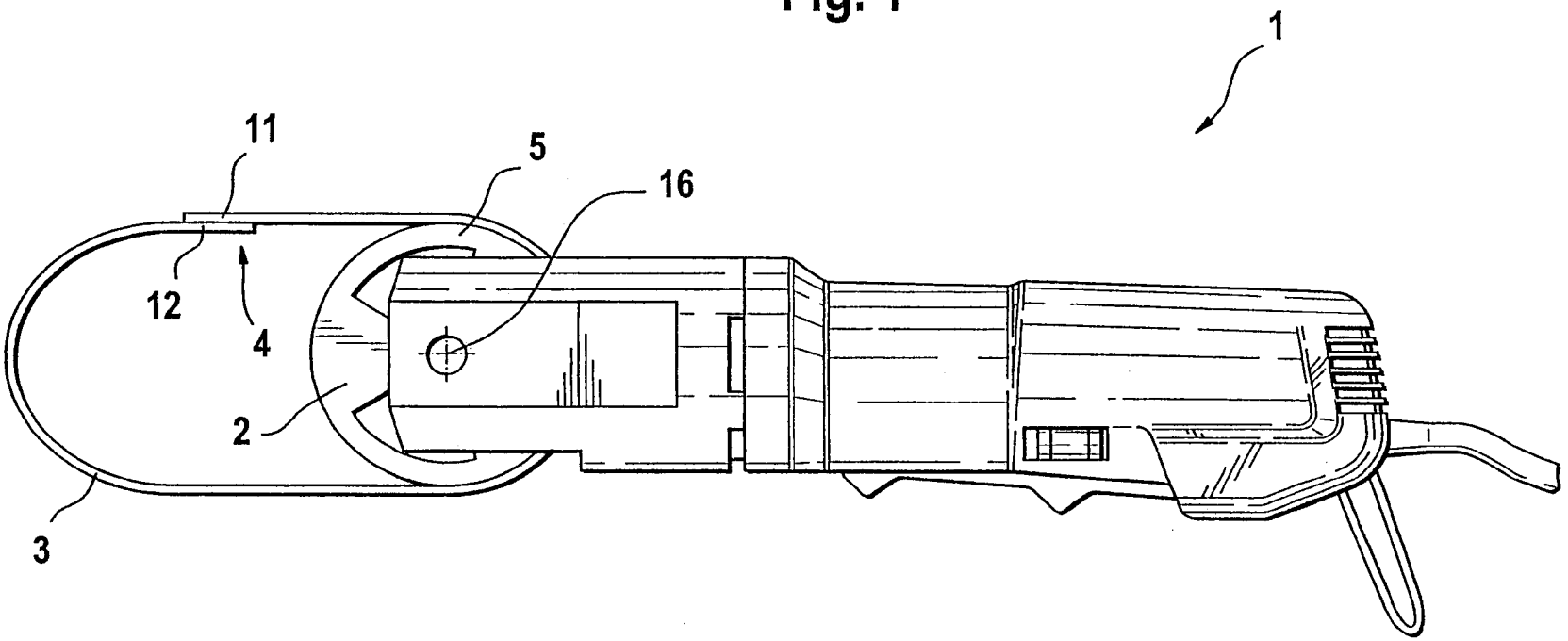
FIG. 1, a first exemplary embodiment of a power grinder with a hook-and-loop closure.

In FIG. 1, a power grinder 1 is shown, which has a drive means 2 in the form of a swing head 5. The drive of the swing head 5 is accomplished by the means described in FIGS. 2 and 3 for a further exemplary embodiment. The swing head 5 is set into an oscillating motion. In the process, it oscillates about a shaft 16. A grinding belt 3 is wrapped around the swing head 5. The grinding belt 3 has a closure 4, by which the first end 11 is releasably connected to the second end 12 of the grinding belt 3 to form a ring. Below a hook-and-loop closure 4 will be described as an example of the closure 4. The hook-and-loop closure 4 is disposed such that it is located between the swing head 5 and an object 17 (FIG. 2) to be machined. This assures very simple changing of the grinding belt 3. All that is necessary is to release the two ends 11, 12, which are in engagement with one another by means of the hook-and-loop closure 4, from another. Moreover, in this exemplary embodiment, once the grinding face of the grinding belt 3, shown on the inside thereof, has become worn down in the region of the object 17 to be machined, this face can be rotated, such that an unused piece of the grinding belt 3 is in contact with the object 17 to be machined. As a result, the grinding belt 3 can be used for longer, thus saving money for the user. To put the power grinder 1 into its machining position, the hook-and-loop closure 4 of the grinding belt 3 is opened. Next, the grinding belt 3 is wrapped around the object to be machined, and the hook-and-loop closure 4 is closed again. With such a grinder 1, the user can instantly begin machining the object 17. Changing a worn grinding belt 3 is equally fast.

Figure 2:
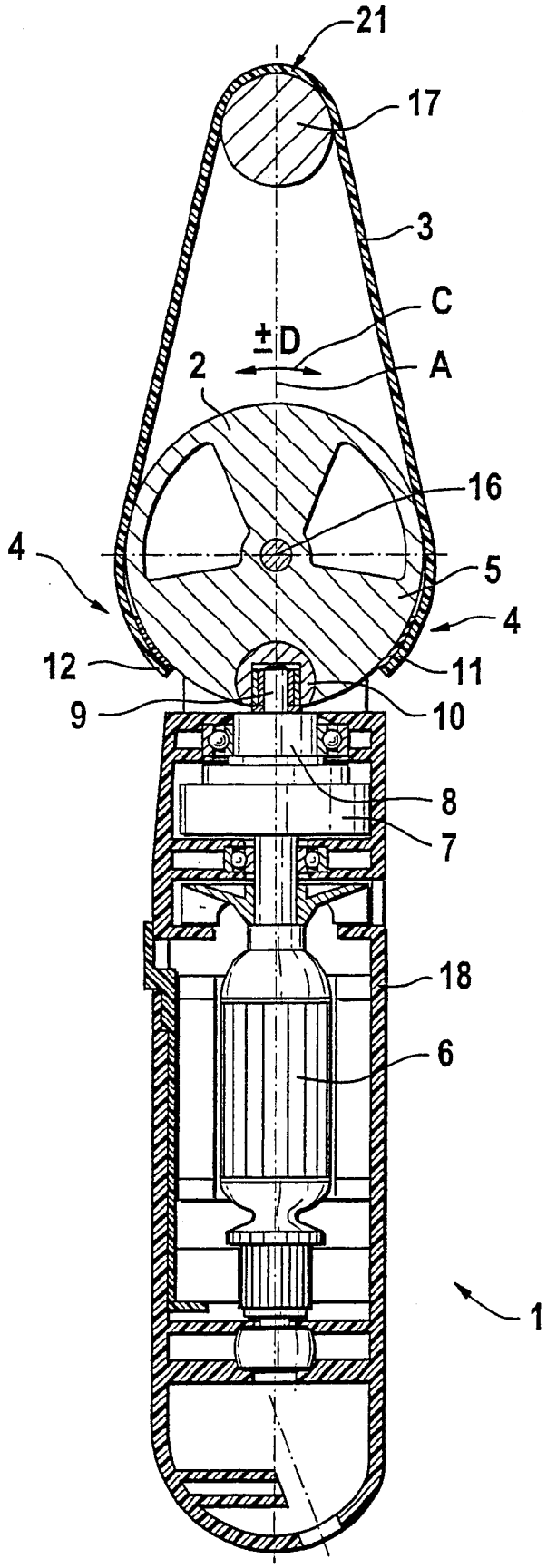
FIG. 2, a section through a second exemplary embodiment of a grinder with a grinding belt with a hook-and-loop closure.
Figure 3:
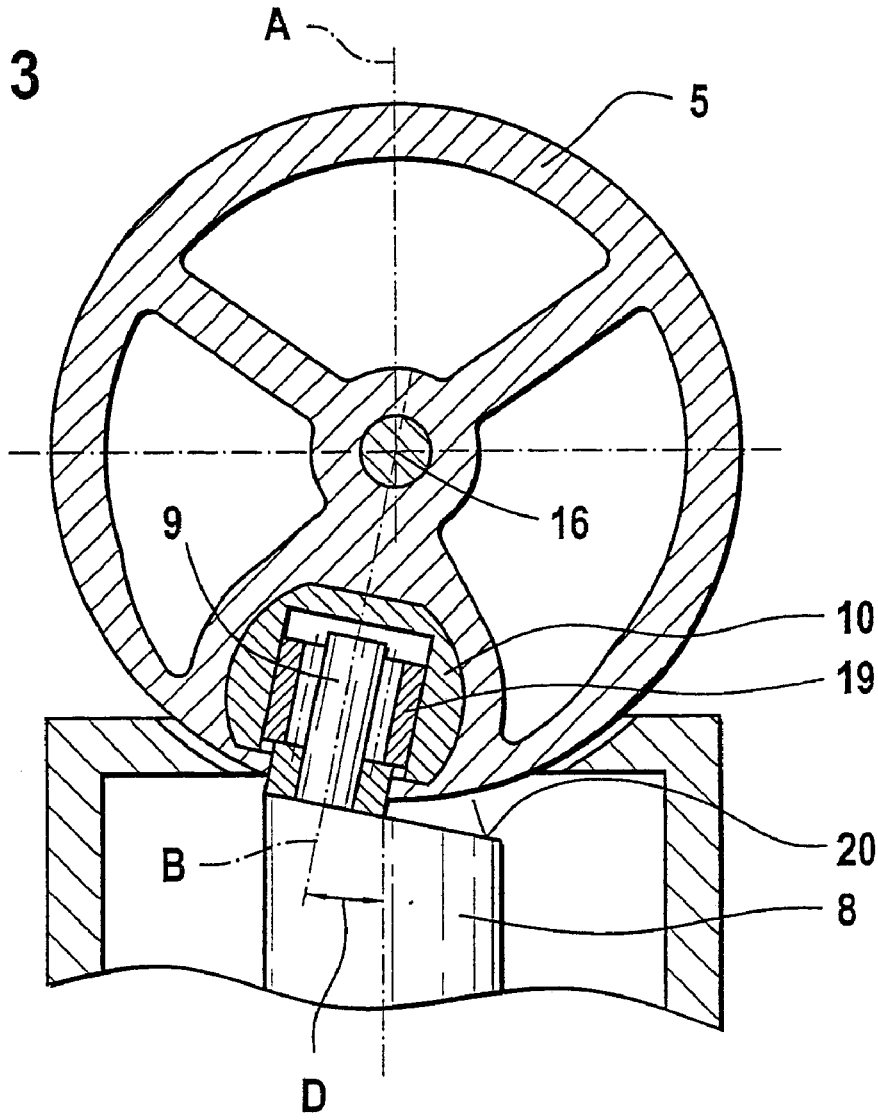
FIG. 3, a schematic detail of FIG. 2 without the grinding belt.

In FIGS. 2 and 3, a second exemplary embodiment of a power grinder 1 of the invention is shown. In principle, this second exemplary embodiment functions like the first exemplary embodiment shown in FIG. 1. Identical parts, or those functioning the same way, are identified by the same reference numerals. Below, only the distinctions from the first exemplary embodiment described above will be addressed.

The swing head 5 is moved by a gear 7, which is supported in a housing 18 of the grinder 1 and is driven by a motor 6. The drive is not essential to the invention, and so these elements will not be described in further detail here. A drive shaft 8, which rotates about a longitudinal axis A of the grinder 1, is embodied on the end of the gear 7. The rotation of the drive shaft 8 is converted into an oscillating motion about a deflection angle D along the double-headed arrow C by means of a peg 9, disposed eccentrically on the drive shaft, that engages a sliding block guide 10 on the swing head 5. This conversion is accomplished by disposing the peg 9 eccentrically to the longitudinal axis A along a peg axis B. Further detail of this embodiment is shown in FIG. 3. On the face end, the drive shaft 8 is defined by a termination area 20 that is tilted relative to the longitudinal axis A. The peg 9 is disposed on this termination area 20, eccentrically to the longitudinal axis A. The peg axis B formed by the peg 9 extends in its extension through the shaft 16 about which the swing head 5 oscillates. The deflection angle D is defined by the spacing between the peg axis B and the longitudinal axis A along the termination area 20. The value of the deflection angle D corresponds to the amplitude that is attained in the oscillation of the swing head 5 about the shaft 16 along the double-headed arrow C (FIG. 2). The peg 9 is supported rotatably in the sliding block guide 10 by means of a bearing 19. In FIG. 3, for the sake of clarity, the grinding belt 3 has not been shown.

The fundamental distinction between this second exemplary embodiment and the first exemplary embodiment shown in FIG. 1 has to do with securing the grinding belt 3. It can be seen from FIG. 2 that both the first end 11 and the second end 12 of the grinding belt 3 are fixed, each by means of a hook-and-loop closure 4, to the swing head 5. For machining the object 17, the grinding belt 3 is detached from the swing head 5 on its first end 11 and/or second end 12, wrapped around the object 17, and then fixed to the swing head 5 again by means of the hook-and-loop closures 4. This assures fast starting of the grinder 1 and equally fast replacement of the grinding belt 3. The grinding region 21 on the object 17 is the region that is remote from the grinder 1. The grinding belt 3 is moved back and forth over the grinding region 21 by the oscillating motion of the swing head 5, as a result of which the surface of the object 17 is ground down in the grinding region 21.

Figure 4:
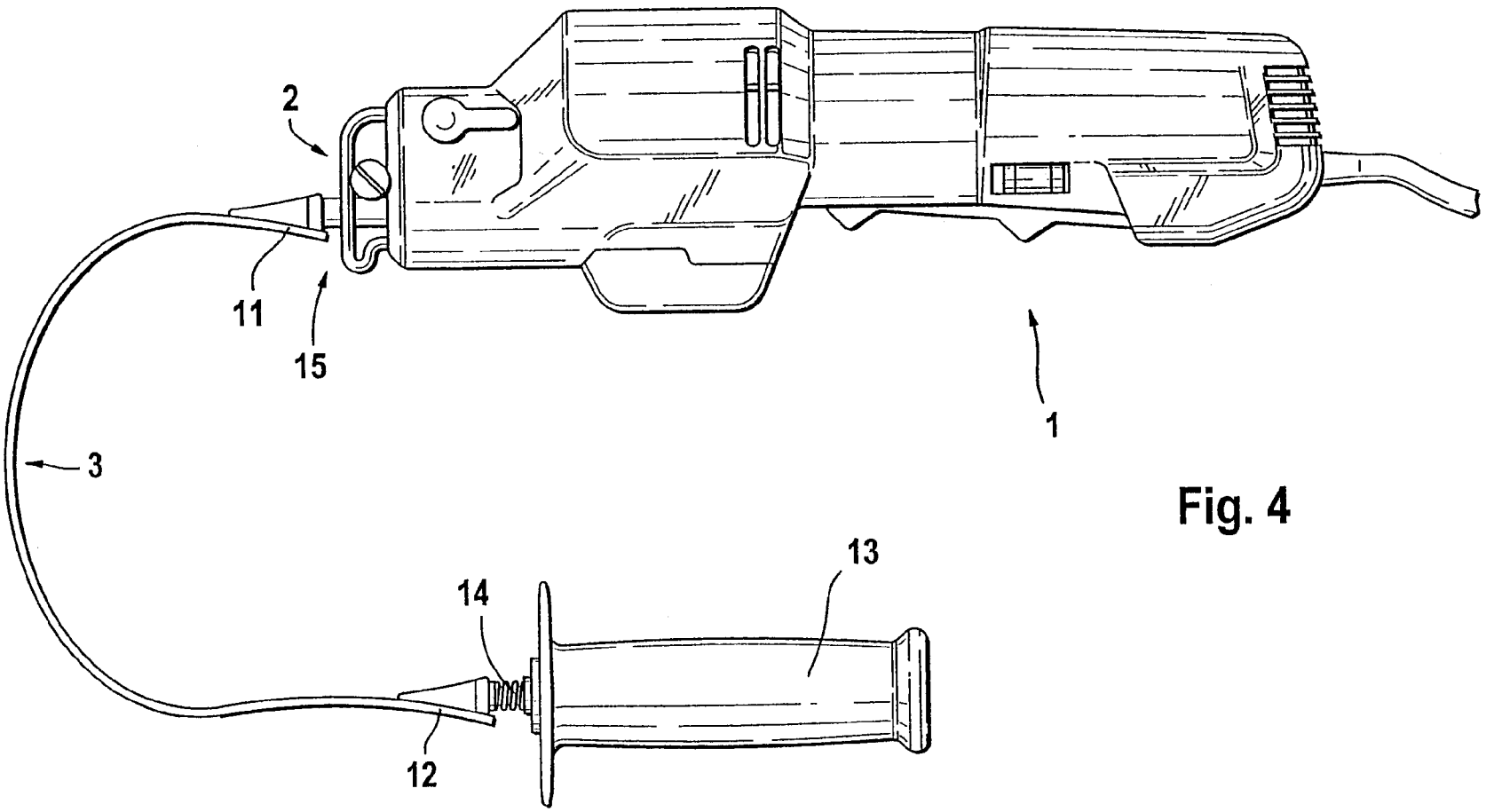
FIG. 4, a third exemplary embodiment of a grinder, with a handle at the end of the grinding belt.

In FIG. 4, a third exemplary embodiment of a power grinder 1 of the invention is shown. Once again, parts that are identical or function identically are identified by the same reference numerals. The first end 11 of the grinding belt 3 is mounted rotatably on the drive means 2. The drive means 2 is embodied on a machine insert 15. A handle 13 is mounted on the second end 12 of the grinding belt 3, via an elastic element 14. A spring 14 will be described below as the elastic element 14. Arbitrary other elastic elements 14 can be used equally well. To enable machining an object 17 (not shown) with such a grinder 1, the handle 13 is wrapped around the object 17, so that the grinding belt 3 rests on the grinding region 21 (not shown) under the tension of the spring 14. A grinding motion takes place in the grinding region 21, as just described above, as a result of the oscillating motion of the drive means 2. By means of the spring 14, the oscillating motion, which is executed by the grinding belt 3 and transmitted to the handle 13, is reduced sharply, so that the user can hold the handle 13 without problems.

An advantage of this exemplary embodiment is that the grinding belt 3 need not be released from the grinder 1. Fast machining of the object 17 is thus assured. It is moreover possible to use the grinding belt 3 over a wide range of its length, depending on the region in which the grinding belt 3 is placed, by means of the handle 13, around the object 17. As a result, the grinding belt 3 can be used longer without having to be replaced. This saves money for the user. This effect is further enhanced if the grinding belt 3 is embodied as a termination area on both sides. Because of the rotatable support of the first end 11 on the drive means 2, the face of the grinding belt 3 that points outward in FIG. 4 can thus also be used for grinding round objects 17. The capability of rotating the grinding belt 3 relative to the drive means 2 offers the further advantage that the user need not assume unnatural hand and arm positions at poorly accessible places on an object 17 to be ground. This enhances the ease of use of the device enormously.

For all three exemplary embodiments, the following items can for instance be used as the grinding belt 3:

A grinding cloth belt, grinding nonwoven, polishing belt, saw wire, bristle belt, or etching belt.

In addition to the use of a hook-and-loop closure 4 on the grinding belt 3, it is equally possible to use push buttons, clamps, screws, hooks, or similar connecting means.

The result is a very broad range of use. With a grinder 1 according to the invention, the following objects can for instance be machined:

A landing, especially a landing on a staircase; a yard fence of round or half-round profile; table and chair legs turned on a lathe; water lines, heating pipes, downspouts for roof gutters; posts; streetlights; traffic lights; and frames for bicycles and motorcycles.

The following machining operations can furthermore be performed: rounding off edges of furniture, machining small parts using stationary grinding and polishing devices, etching, removing adhesive residues, sawing circular cutouts, and sawing pipes using saw wire.

| List of Reference Numerals | |
|---|---|
| 1 | Power grinder |
| 2 | Drive means |
| 3 | Grinding belt |
| 4 | Closure, in particular hook-and-loop closure |
| 5 | Swing head |
| 6 | Motor |
| 7 | Gear |
| 8 | Drive shaft |
| 9 | Peg |
| 10 | Sliding block guide |
| 11 | First end |
| 12 | Second end |
| 13 | Handle |
| 14 | Elastic element, in particular spring |
| 15 | Machine insert |
| 16 | Shaft |
| 17 | Object |
| 18 | Housing |
| 19 | Bearing |
| 20 | Termination area |
| 21 | Grinding region |
| A | Longitudinal axis |
| B | Peg axis |
| C | Double-headed arrow |
| D | Deflection angle |

What is claimed is:

1. A power grinder (1), comprising a motor (6) and a gear (7), wherein said motor and gear drive an oscillating drive means (2) about a deflection angle (D), wherein said drive means drives a grinding belt (3), secured to said drive means, to reciprocate, wherein the grinding belt (3) is detachably connectable to a ring; and a hook-and-loop closure detachably connecting the grinding belt (3) to the ring.

2. The grinder (1) of claim 1, wherein the drive means (2) is a swing head (5) having the form of a wheel.

3. The grinder (1) of claim 1, wherein the drive means (2) is a machine insert (15).

4. A power grinder (1), comprising a motor (6) and a gear (7), wherein said motor and gear drive an oscillating drive means (2) about a deflection angle (D), wherein said drive means drives a grinding belt (3) secured to said drive means, wherein the grinding belt (3) is disposed with a first end (11) on the drive means (2) and a second end (12) is connected to a handle.

5. A power grinder, comprising a motor and a gear, wherein said motor and gear drive an oscillating drive means about a deflection angle, wherein said drive means drives a grinding belt, secured to said drive means, to reciprocate, wherein the grinding belt is detachably connectable to a ring by means of a hook-and-loop closure, wherein the closure is in engagement with the drive means.

6. A power grinder, comprising a motor and a gear, wherein said motor and gear drive an oscillating drive means about a deflection angle, wherein said drive means drives a grinding belt, secured to said drive means, to reciprocate, wherein the grinding belt is detachably connectable to a ring by means of a hook-and-loop closure, wherein the gear, on a side remote from the motor, has a drive shaft on a face end, wherein a peg is disposed accentrically on said shaft and wherein said peg is in engagement with the drive means.

7. A power grinder, comprising a motor and a gear, wherein said motor and gear drive an oscillating drive means about a deflection angle, wherein said drive means drives a grinding belt, secured to said drive means, to reciprocate, wherein the grinding belt is detachably connectable to a ring by means of a hook-and-loop closure, wherein the gear, on a side remote from the motor, has a drive shaft on a face end, wherein a peg is disposed eccentrically on said shaft and wherein said peg is in engagement with the drive means, and wherein the eccentric peg is disposed at an angle to the drive shaft that is equal is size to the deflection angle of the drive means.

8. A power grinder, comprising a motor and a gear, wherein said motor and gear drive an oscillating drive means about a deflection angle, wherein said drive means drives a grinding belt, secured to said drive means, to reciprocate, wherein the grinding belt is detachably connectable to a ring by means of a hook-and-loop closure, wherein the gear, on a side remote from the motor, had a drive shaft on a face end, wherein a peg is disposed eccentrically on said shaft and wherein said peg is in engagement with the drive means, wherein the peg is seated in a sliding block guide on the drive means.

9. A power grinder, comprising a motor and a gear, wherein said motor and gear drive an oscillating drive means about a deflection angle, wherein said drive means drives a grinding belt, secured to said drive means, to reciprocate, wherein the grinding belt is detachably connectable to a ring by means of a hook-and-loop closure, and wherein the closure is embodied on a first end and on a second end of the grinding belt.

10. The grinder (1) of claim 9, wherein an elastic element (14) is disposed between the second end (12) of the grinding belt (3) and a handle (13).

11. The grinder (10) of claim 9, wherein the first end (11) of the grinding belt (3) is mounted rotatably on the drive means (2).

* * * * *